US008262393B2

(12) United States Patent
Adams

(10) Patent No.: US 8,262,393 B2
(45) Date of Patent: Sep. 11, 2012

(54) ROSARY

(76) Inventor: William E. Adams, Portersville, PA (US)

( * ) Notice: Subject to any disclaimer, the term of this patent is extended or adjusted under 35 U.S.C. 154(b) by 0 days.

(21) Appl. No.: 12/862,993

(22) Filed: Aug. 25, 2010

(65) Prior Publication Data

US 2011/0053130 A1 Mar. 3, 2011

Related U.S. Application Data

(62) Division of application No. 10/873,903, filed on Jun. 22, 2004, now abandoned.

(51) Int. Cl.
*A44C 23/00* (2006.01)

(52) U.S. Cl. ..... 434/246

(58) Field of Classification Search ..... 434/188, 434/203, 204, 246; 63/1.11, 3, 4, 10, 21, 63/23; 368/224, 225
See application file for complete search history.

(56) References Cited

U.S. PATENT DOCUMENTS

| | | | | |
|---|---|---|---|---|
| 1,525,005 | A | 2/1925 | Sherman | |
| 1,579,820 | A * | 4/1926 | Kislinger | 63/3 |
| 2,187,664 | A | 1/1940 | Rogus | |
| 2,677,901 | A | 5/1954 | Tilleman | |
| 2,717,737 | A * | 9/1955 | Hoelscher | 235/106 |
| 2,769,249 | A | 11/1956 | Illes | |
| 2,937,459 | A * | 5/1960 | Belfield | 434/246 |
| 2,990,625 | A | 7/1961 | Mues | |
| 2,992,495 | A | 7/1961 | Perreira | |
| 3,374,949 | A | 3/1968 | Cecil | |
| 3,549,464 | A | 12/1970 | Nabinger | |
| 6,057,009 | A | 5/2000 | McGlew | |
| 6,179,621 | B1 | 1/2001 | Vaccari | |
| 6,589,056 | B2 | 7/2003 | McGovern | |
| 6,832,882 | B2 * | 12/2004 | Janisch et al. | 411/433 |
| 6,901,771 | B2 * | 6/2005 | Ooide | 63/26 |
| 7,513,774 | B2 * | 4/2009 | Krilich | 434/246 |
| 2003/0086521 | A1 | 5/2003 | Rana | |

FOREIGN PATENT DOCUMENTS

JP 408126507 A 5/1996

* cited by examiner

*Primary Examiner* — Kurt Fernstrom
(74) *Attorney, Agent, or Firm* — Buchanan Ingersoll & Rooney PC

(57) ABSTRACT

A rosary prayer device has a ring or elongated housing containing a series of stops. The stops are arranged in five groups of five or ten with a starting space adjacent one of the groups of stops. A bead is positioned on the ring and sized to travel around the ring and remain between any two selected stops on the ring until pushed over one of the two selected stops. A user pushes the bead to the next stop after saying each prayer of the rosary.

18 Claims, 10 Drawing Sheets

ROSARY

CROSS-REFERENCE TO RELATED APPLICATION

This application is a divisional application claiming priority to U.S. patent application Ser. No. 10/873,903, filed on Jun. 22, 2004 now abandoned.

FIELD OF INVENTION

The invention relates to religious items and more particular to a rosary.

BACKGROUND OF INVENTION

In general, a rosary is a string of beads formed into a loop. The beads are arranged in groups of ten (decade) and the groups are separated by a lone bead. The group of five decades is usually preceded by a short string of four beads, usually atop a crucifix. The beads within the decade are usually of the same size and configuration and all the beads in the decade are a uniform distance apart with the lone bead spaced a greater distance from the end bead in the decade than the end bead in the decade is spaced from the next bead in the decade. Sometimes, the separating bead is larger, or shaped slightly different. A Roman Catholic's rosary has five or fifteen decades. Each bead is emblematic of a prayer and the prayers are emblematic of a religious event. Therefore, when someone "prays the rosary," he touches each bead in turn and says the right prayer for the particular bead he touches.

One problem with the rosary is that the string of beads can become tangled when placed in a pocket or purse. The string of beads may become knotted or may become entangled with other objects. Some people keep their rosary in a pouch or other container which is used exclusively for that purpose. But many people place a rosary in a pocket, purse or drawer with other objects where the rosary becomes entangled with one or more of those objects. Then the person must untangle the rosary before it can be used.

McGlew in U.S. Pat. No. 6,057,009 discloses a hand held memory device that can be used in place of a rosary while "praying the rosary." This device has a slide strip having ten indicators as hemispherical projections. The slide strip fits in a slot in a base unit which can be held in one hand. The user places his or her thumb on a projection, says a prayer and then moves the thumb to the next projection for the next prayer. This movement to the next projection is accomplished by sliding the strip along the base unit. The unit changes in size, and is difficult to put back into a pocket. It also only tracks one decade and does not show the user where he or she must restart.

McGovern discloses a hand held, hand operated mechanical, rosary prayer sequence symbol prompter in U.S. Pat. No. 6,589,056. This device contains a ring having 60 teeth and contained in a circular housing. Within the housing are six multi-sided and one circular symbol. A push button and ratchet is provided to rotate the ring. As the ring rotates multi-sided symbols will in sequence project from or be within the housing. The user pushes the button after each prayer to turn the ring. The positions of the symbols will tell the user which prayer must be said at any point in time while praying the rosary.

While the counters disclosed by McGovern and McGlew are helpful in keeping track of prayers, use of these devices is quite different from advancing the beads of a rosary while praying. Consequently, there is a need for a rosary which relies upon the traditional movement of at least one bead to keep track of prayers.

The art has also provided a number of marker devices that can be used in combination with a string of rosary beads. Many of these devices have a channel or sleeve through which the beads pass. Examples of this type of product are disclosed in U.S. Pat. Nos. 2,937,459 and 2,992,495, published application US 2003/00086521 A1 and Japanese application JP 408126507 A. Another type of marker has a clip that is placed between adjacent beads. U.S. Pat. Nos. 2,990,625 and 6,179,621 disclose rosary beads having this type of marker.

There is a need for a rosary in which a bead is moved along a path after each prayer as in a conventional rosary. Rather, then the path being defined by a string, the path should be such that the rosary does not become tangled itself or with other objects.

SUMMARY OF THE INVENTION

I provide a rosary prayer device having a ring or elongated housing. Stops are provided in five groups of five or ten stops along the ring or housing. I prefer to provide a starting space that may have stops for the introductory prayers. The ring or housing passes through a bead having a projection which keeps the bead between two selected stops until the bead is pushed over a stop by the user. The stops may be projections or grooves. In one embodiment the housing has ten flat sides and the passageway through the bead is similarly shaped with ten flat sides. The bead is rotated around the housing.

The ring may be circular, oval or pentagon in shape. The elongated housing may be coiled or any other desired shape. For some users, I prefer to provide a housing which can be deformed by the user into any desired shape.

In another embodiment the bead and housing are molded as a unitary structure. The bead is detached from the housing and placed in position by the user.

Other objects and advantages of the rosary prayer device will become apparent from certain present preferred embodiments shown in the drawings.

DESCRIPTION OF THE PREFERRED EMBODIMENTS

Figure 1:
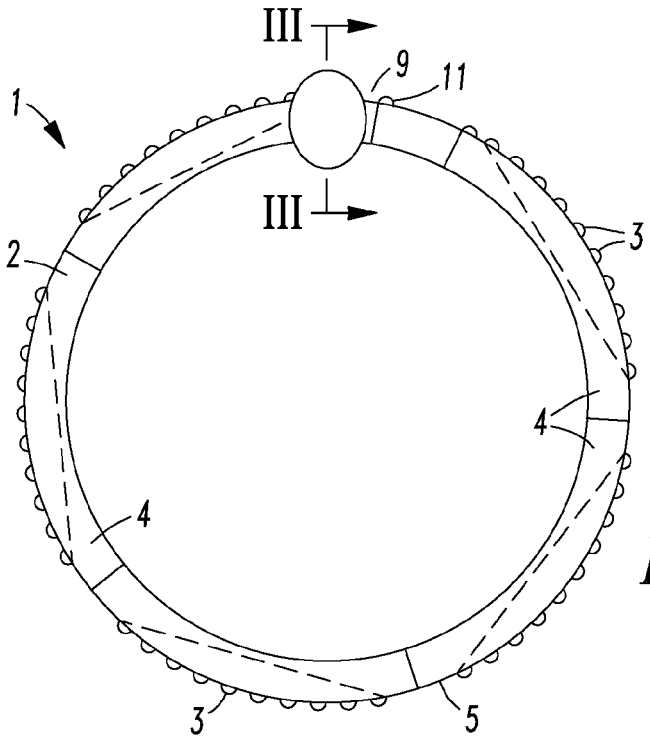
FIG. 1 is a side view of the first present preferred embodiment of my rosary prayer device.
Figure 2:
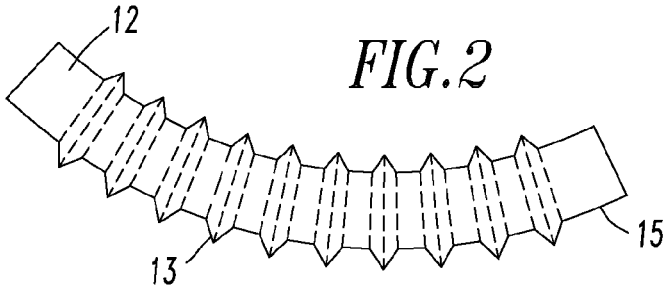
FIG. 2 is an enlarged fragmentary view of a portion of the embodiment of Figure showing an alternative arrangement for the outer surface.
Figure 3:
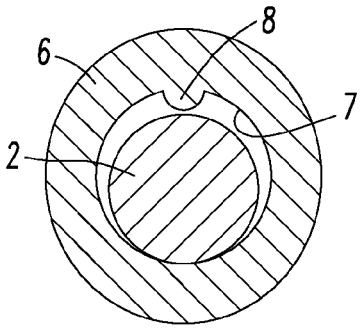
FIG. 3 is a sectional view taken along the line III-III in FIG. 1.

A first present preferred embodiment of my rosary prayer device 1, shown in FIG. 1, has a ring 2 with projections along the circumference of the ring. I prefer that the ring have a diameter of about 2.5 to 3 inches, though it could be as small as a finger ring. Since the complete rosary prayer utilizes five decades of beads, I prefer to provide a total of five distinct sections 4 on the ring. As can be seen in FIG. 1, I prefer to provide lines on the ring such that each line indicates where one section ends and the next section begins. I also prefer to provide a starting space which may have stops 11. This short section is for introductory prayers. If desired each line provided on the ring to mark each section or adjacent sections could be different colors. Each section contains ten stops. I prefer to provide a flat portion 5 free of projections or stops between each group of ten projections or with one projection in the middle of the flat section. An alternative is to provide a distinctive tactile pattern that can be identified, even in the dark, as the bead is pushed along. A bead 6 is provided on the ring as can be seen in FIG. 3. A projection 8 extends into the central bore 7 through bead 6. This projection 8 engages stops 3. Consequently, the bead will be retained in a position between two adjacent stops until a force pushes the bead forward. I prefer to make the ring and bead of a material such that the projection is sized and shaped so that an audible click is heard or a tactile change is felt as the bead passes over each projection. Then the user can feel or hear when the bead passes over a projection. The projections 3 may be hemispherical bumps, ridges or even threads. In an alternative embodiment shown in FIG. 2 the stops are grooves 13 provided in a saw tooth-like outer surface of the ring 12. If grooves are used as stops the bead would be located over a groove and between the projections on either side of that groove. The stops could be in the inner surface or on a side of the ring. Or, the projections and grooves may extend completely around the ring 12 as shown in dotted line in FIG. 2.

Figure 4:
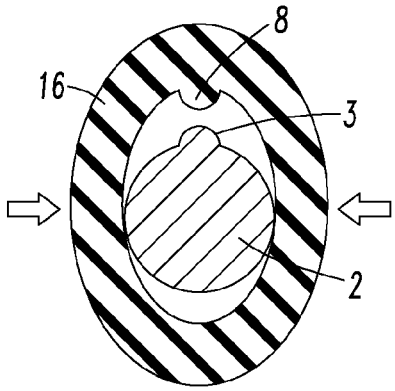
FIG. 4 is a sectional view similar to FIG. 3 showing an alternative embodiment of a bead that could be used in the embodiment of FIG. 1.

If desired, the bead can be made of a flexible material such as bead 16 shown in FIG. 4. As indicated by the arrows in the figure, one squeezes the bead to move the tab 8 away from the projections 3 allowing the bead advance over the projection. When one removes the force, the bead relaxes and then rests between adjacent projections or stops. The bead could be an O-ring that flexes or rolls as it is pushed over each projection.

Figure 5:
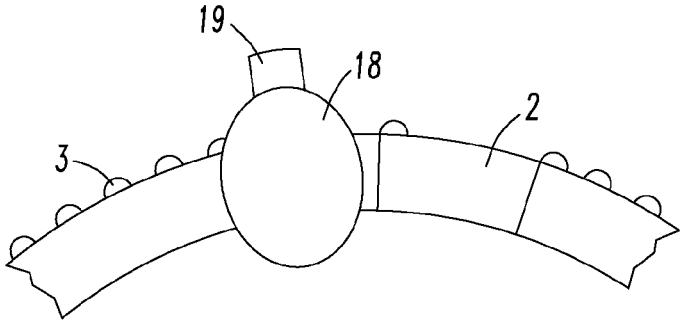
FIG. 5 is a fragmentary view similar to FIG. 2 showing an alternative embodiment of a bead on a portion of a ring in the embodiment of FIG. 1.

An alternative embodiment of the bead 18 is shown in FIG. 5. This bead has an arm or tab 19 extending outward from the bead to assist one in moving the bead along the ring 2. This arm may fold or retract into the bead.

If desired the ring could have flat portions indicated by dotted line 10 in FIG. 1 giving the ring a pentagon shape. One decade of stops would be on each flat portion. Two of those portions may be separated by a short starting space for the introductory prayers.

Figure 6:
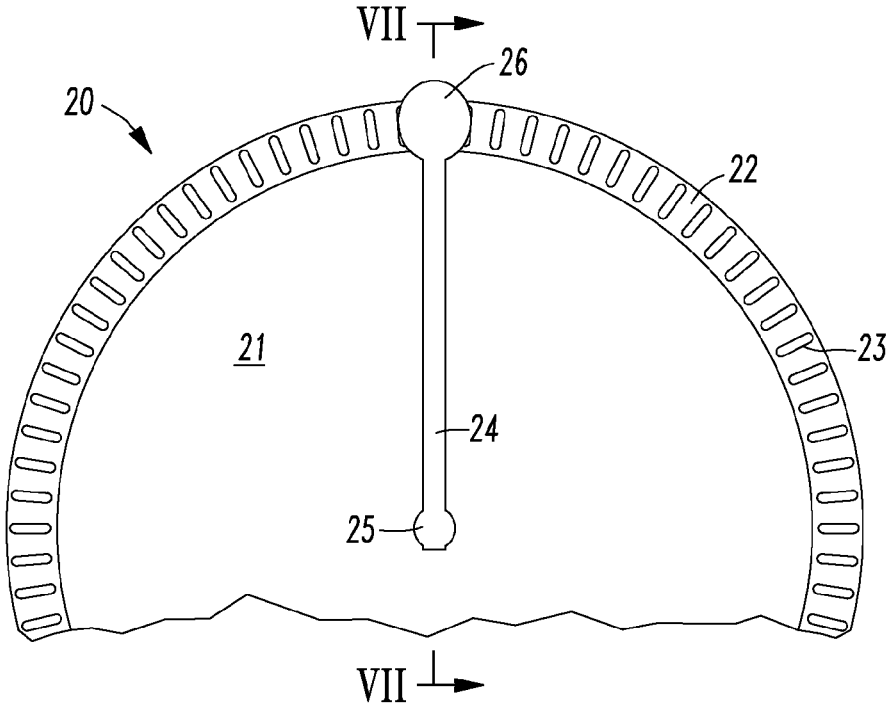
FIG. 6 is a side view of a second present preferred embodiment of my rosary prayer device.
Figure 7:
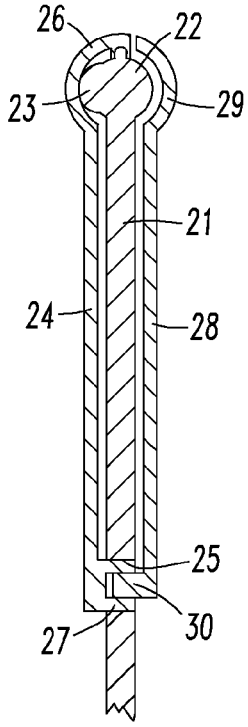
FIG. 7 is a sectional view taken the lines VII-VII in FIG. 6.

A second preferred embodiment shown in FIGS. 6 and 7 has a ring 22 with a series of ridges 23 that act as stops. The ring surrounds a flat circular housing 21 having a hole 25 in its center. Arm 24 is provided on one side of the housing 21. The arm has a hollow post 27 that fits through opening 25 in the housing 21. The other end of the arm has a bead shape 26 which fits over at least a portion of the ring. A similarly shaped back arm 28 is provided on the opposite side of the housing. This arm has a bead portion 29 which extends over a portion of the ring 22. A solid post 30 at the opposite end of arm 28 fits within hollow post 27. Arm 24 could be used without the reinforcement provided by arm 28.

Figure 9:
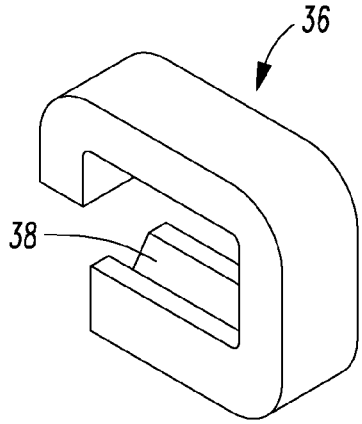
FIG. 9 is a perspective view of the bead used in the embodiment shown in FIG. 8.
Figure 8:
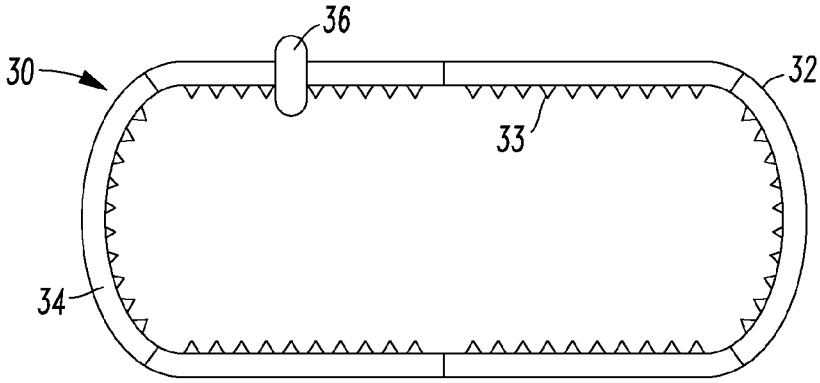
FIG. 8 is a side view of a third present preferred embodiment of my rosary prayer device.

A third present embodiment 31 shown in FIGS. 8 and 9 has an oval ring 32 with projections 33. Each section 34 of the ring has ten projections or stops. The bead 36 is C-shaped having a projection 38 on an inner surface. The projection 38 cooperates with the stops 33 on the ring 32 to position the bead 36.

Figure 10:
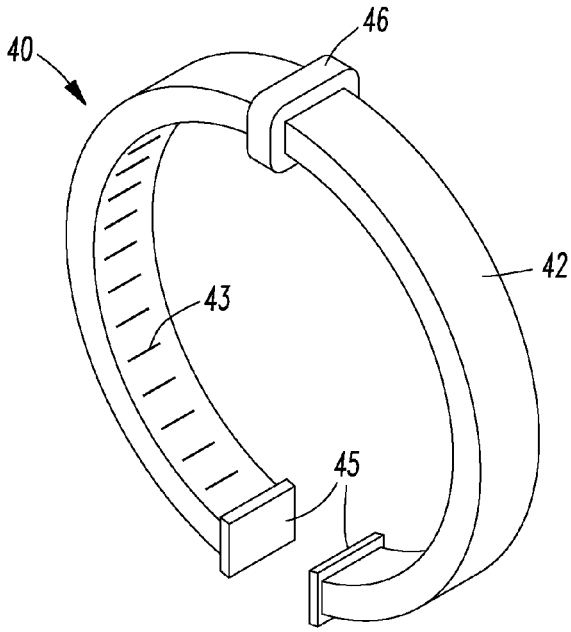
FIG. 10 is a side view of a fourth present preferred embodiment of my rosary prayer device.

A fourth embodiment 40 shown in FIG. 10 has an elongated housing 42 shaped like a bracelet or necklace. Bead 46 travels over the bracelet stops. Stops 43 are provided to position the bead as in the previous embodiment. The ends 45 are blocked or joined together so the bead 46 does not fall off of the bracelet 40.

A fifth embodiment 50 of my rosary prayer device has an elongated housing 52 with stops 53. This housing is in the shape of a spiral or coil. Bead 56 is provided on the housing and operates in the same manner as in the previous embodiments. A cap 54, tab or other structure is provided at each end of the housing to keep the bead on the housing.

Figure 12:
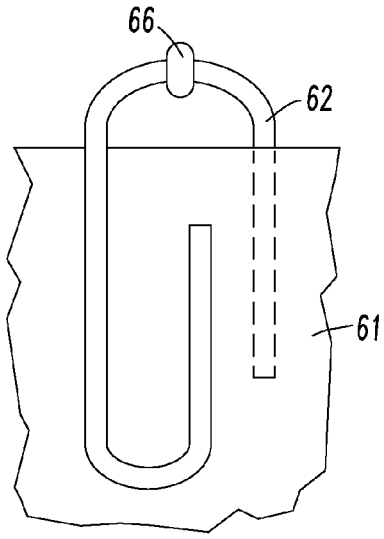
FIG. 12 is a side view of a sixth present preferred embodiment of my rosary prayer device positioned on a fragment of paper.

A sixth embodiment of my rosary prayer device 60 is shown in FIG. 12. This embodiment has an elongated housing 62 in the shape of clip which can fit over a page 61. Stops 63 are provided on the housing and cooperate with bead 66 as it is moved along the housing.

Figure 11:
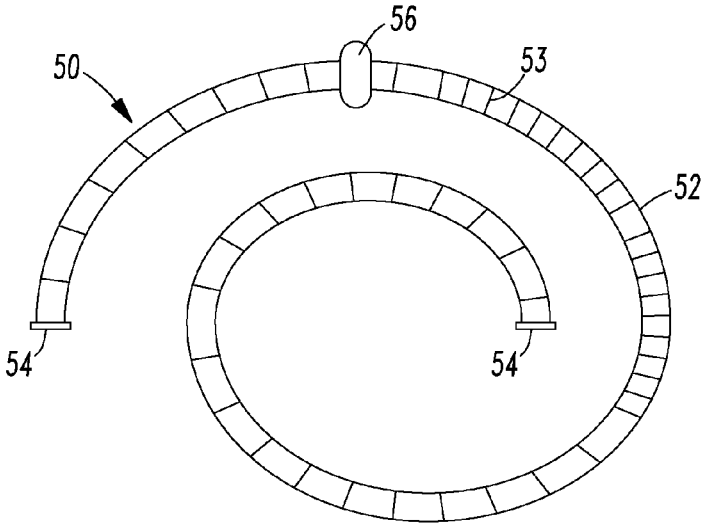
FIG. 11 is a side view of a fifth present preferred embodiment of my rosary prayer device.

It should be apparent from the embodiments shown in FIGS. 10, 11 and 12 that the elongated housing could be deformable such that the user could bend it into any desired shape. Certain plastics and metals when formed into a wire can be deformed in this manner.

Figure 13:
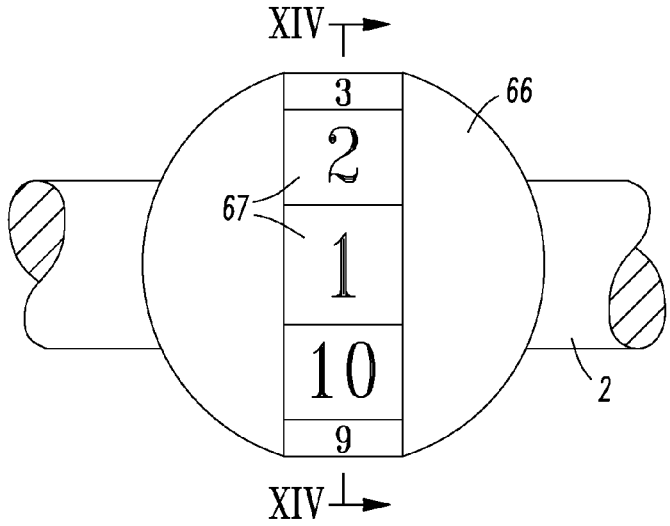
FIG. 13 is a top plan view of another preferred embodiment of a bead that can be used in my rosary prayer device.
Figure 14:
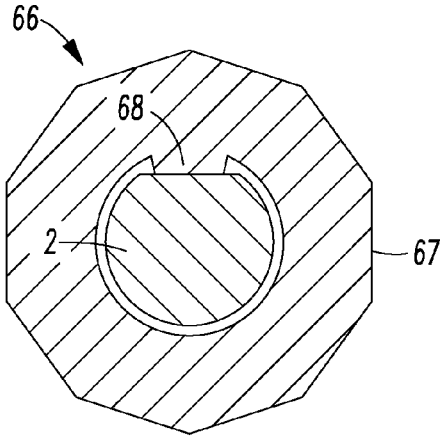
FIG. 14 is a sectional view taken along the line XIV-XIV in FIG. 13.

I may also provide a bead 66 shown in FIGS. 13 and 14 which has ten flat segments 67 that extend around the bead. Each segment has a number from 1 to 10. A projection or internal threads 68 is provided to cooperate with the stops and enable the bead to turn on the housing as the bead is pushed forward. As the bead advances it rotates on the ring or housing exposing the flat segments 67 on the bead in sequence. A different number faces outward after each stop is passed. In this way the user may keep track of the number of prayers that have been said. This type of bead could be used in any of the embodiments that are disclosed herein.

Figure 15:
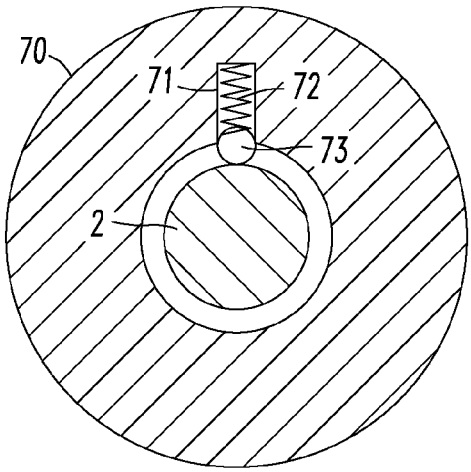
FIG. 15 is a sectional view of another preferred bead.

Another present preferred bead 70 shown in cross section in FIG. 15 has an internal cavity 71 containing a spring 72 which presses against a ball 73. The ball functions in the same manner as the projections 8 in the bead shown in FIGS. 3 and 4. The ball need not be spherical but can be any shape which functions like the projection 8 in the previous embodiments. This bead 70, as well as beads 6, 16 and 36 shown in FIGS. 3, 4 and 9, could be rotated so that the projections 8, 38 or ball 23 are not aligned with the stops allowing the bead to be easily slid back to the beginning for the next rosary.

Figure 16:
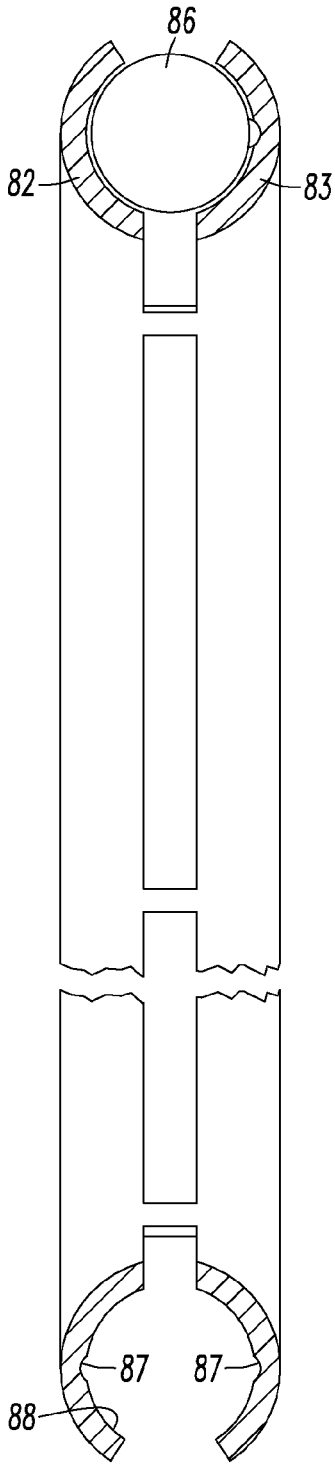
FIG. 16 is a cross-sectional view of a seventh preferred embodiment of my rosary prayer device.

A seventh present preferred embodiment 80 shown in FIG. 16 has a ring 81 similar to the ring 2 in the embodiment of FIG. 1. However, this ring 81 is formed by two spaced apart C-shaped halves 82, 83 joined together by a bridge 84 at selected locations around the circumference. The bead 86 fits and travels between the two halves 82, 83. The outer surface of the bead contains a notch or projection 85 that engages stops 87 provided on the inside surface 88 of one or both halves 82, 83. A similar device can be created by forming the ring as a coiled spring with the bead traveling between adjacent surfaces. This ring would be similar to the ring in a conventional key ring and the bead would follow the path taken by a key as the key is placed on or removed from the ring. In a somewhat similar variation the spring would have five or fifteen loops in it. A moving bead pushed along the spring or between adjacent coils of the spring would interact with notches or projections along the way so the prayers could be counted.

Yet another embodiment could be made by substituting the ring 81 shown in FIG. 16 for the ring 22 in the embodiment shown in FIGS. 6 and 7. As in the embodiment of FIG. 16 the bead would travel inside the ring. An arm similar to arm 24 could be attached to the bead. In one version the arm moves clockwise or counter-clockwise around the housing 21. In another version the arm and bead are fixed relative to the housing and the ring is turned clockwise or counter-clockwise relative to the housing.

Figure 17:
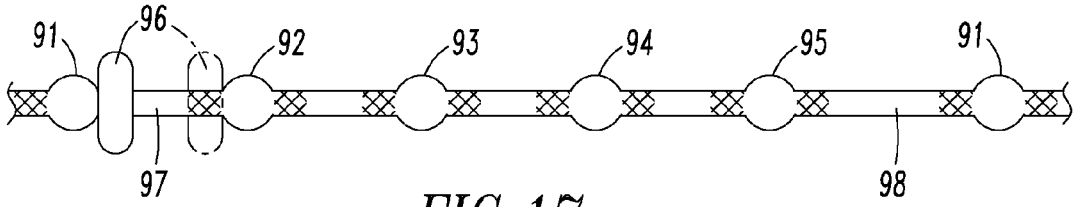
FIG. 17 is a side view of a portion of a housing and bead that could be used in the embodiments of FIGS. 1, 8 and 10 through 12.
Figure 18:
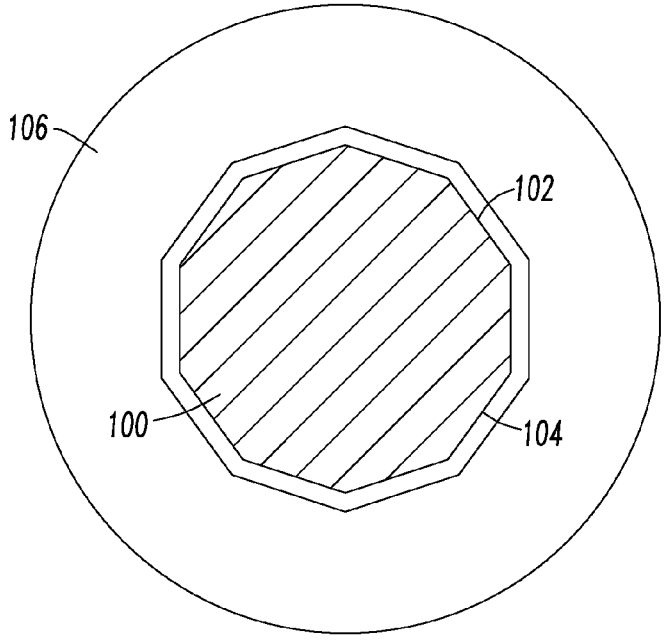
FIG. 18 is a sectional view of a housing with a bead that could be used in the embodiments of FIGS. 1, 8 and 10 through 12.

The embodiments shown in FIGS. 1, 8 and 10 through 12 could have rings or housings configured as shown in FIGS. 17 and 18. In the modification illustrated in FIG. 17 there are five groups of five stops 91, 92, 93, 94, 95 rather than five groups of ten stops on the housing 90. Adjacent stops are separated by a segment 97 of sufficient length that the bead 96 could be moved from a position adjacent one stop 91 to a position (shown in dotted line) adjacent the next stop 92. A prayer could be said when the bead is adjacent the first stop. The bead is moved to a position adjacent the second stop 92. Then the next prayer is said. Then the bead is moved to a position adjacent the next stop 93 and the prayer is said. The process is continued until all prayers have been said. A longer segment 98 of the housing 90 separates each group of five stops. Each stop position of the bead could be marked as indicated by shading 99, by painting, marking, knurling or otherwise treating the stop positions on the housing to make each position visible. If desired the positions could be numbered.

In the variation illustrated in FIG. 18, the housing 100 has ten flat sides 102 so that a cross section of the housing is a decahedron. The bead 106 has a central passage 104 which is shaped as a slightly larger decahedron. The bead is turned after each prayer is said. The bead and housing may be made of plastics of a selected hardness so that an audible click is heard each time the bead is turned. After the rotations the bead is then advanced along the housing to a next section having ten flat sides and the process is repeated. Each section of ten flat sides is equivalent to one group of ten projections or ten notches in the embodiments previously described.

Figure 19:
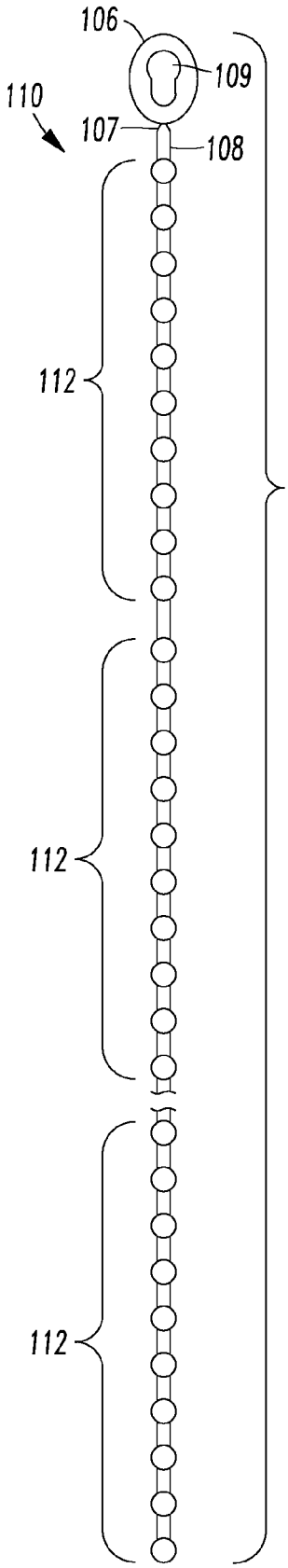
FIG. 19 is a top plan view of an eighth preferred embodiment of my rosary prayer device which is molded as a unitary structure.
Figure 20:
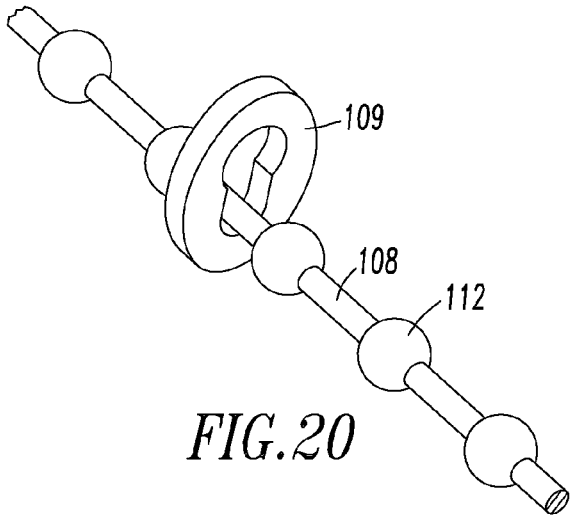
FIG. 20 is a perspective view of a portion of the embodiment of FIG. 19.

The present invention could be molded as a unitary structure 110 shown in FIG. 19 with an elongated housing having five groups of five or ten stops 112 and the bead 106 attached to the housing 108 by a frangible joint 107. The bead has a keyhole-shaped passage 109. The device is sold in the form shown in FIG. 19. The user breaks frangible joint 107 to remove the bead 106 from the elongated housing 108. Then the user places the bead on the housing as shown in FIG. 20 and uses the device in the same manner as the previous embodiments. The keyhole 109 is shaped so that the larger opening is close to the diameter of the stops and the smaller diameter is close to the diameter of the segments between stops. The ends of housing 108 could be configured to connect together forming a loop or ring.

Figure 21:
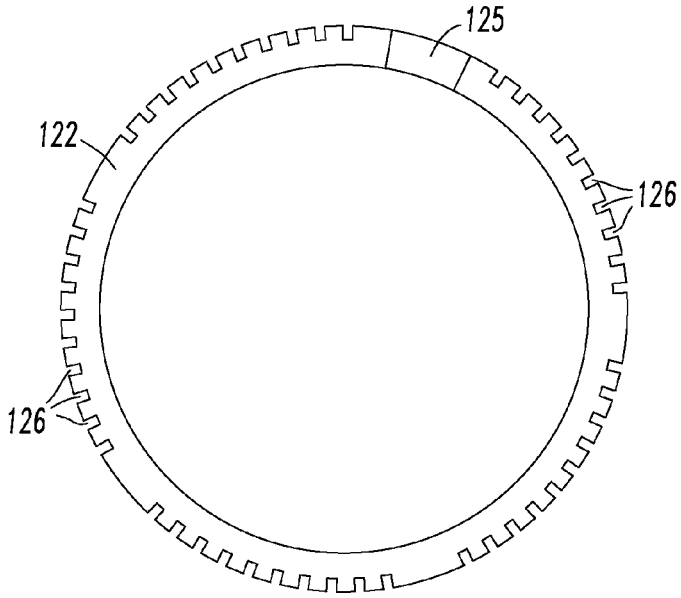
FIG. 21 is a side view of a ring used in an eighth present preferred embodiment of my rosary prayer device.
Figure 22:
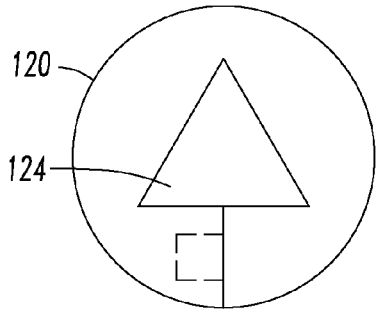
FIG. 22 is an end view of the bead used on the ring shown in FIG. 21.
Figure 23:
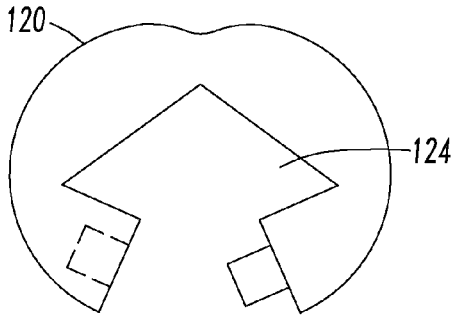
FIG. 23 is an end view of the bead shown in FIG. 22 wherein the bead is open for placement on the ring.

Yet another embodiment can be made by placing the bead 120 shown in FIGS. 22 and 23 on the ring 122 shown in FIG. 21. This ring 122 has a triangular cross section. The bead 120 has a triangular bore 121 which enables the bead to travel along the ring. As can be seen in FIG. 23 the bead can be opened so that the ring 122 can be fitted through the opening 124. Then the bead is snapped back to the shape shown in FIG. 22. The bead is first placed on the smooth area 125 of the ring 122 and then advanced from slot to slot 126 after each prayer.

Figure 24:
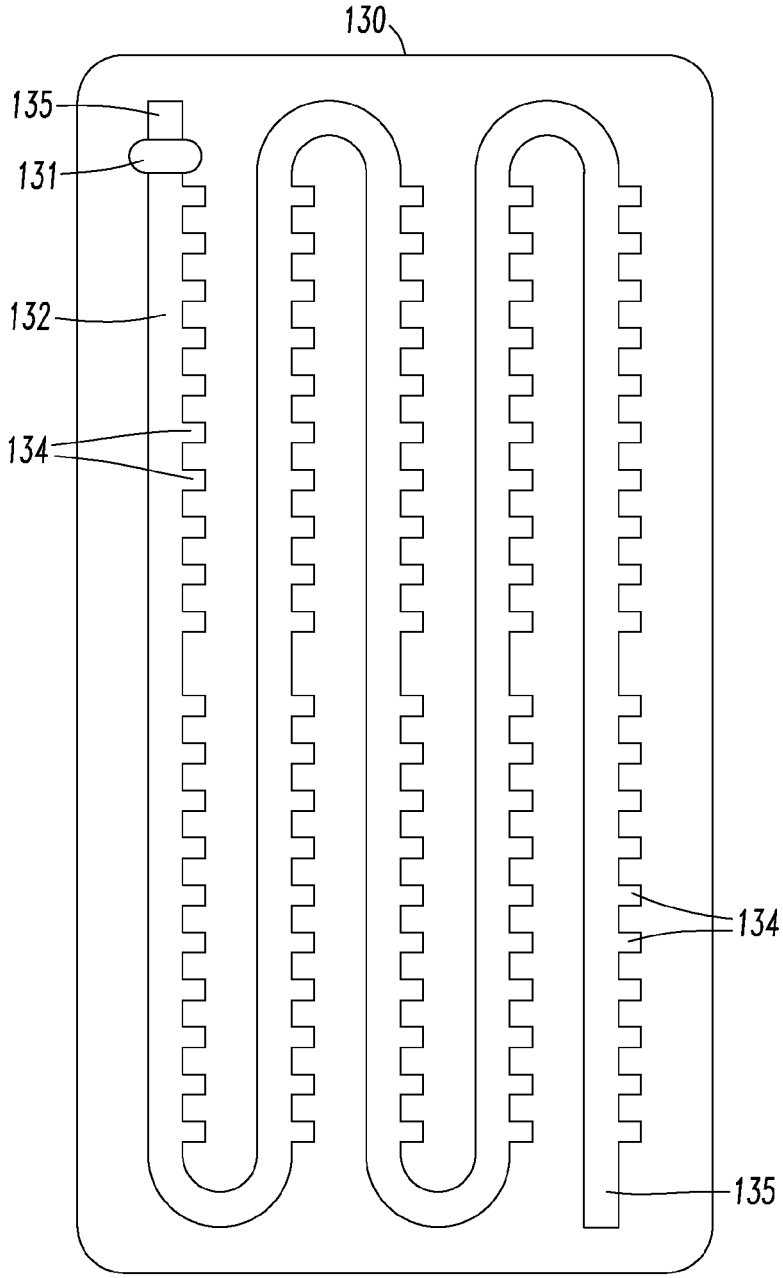
FIG. 24 is a top plan view of a ninth present preferred embodiment of my rosary prayer device.

In yet another embodiment shown in FIG. 24, the bead 131 is placed in a groove or track 132 in housing 130 over which the bead travels. Projections or slots 134 are provided along the track which act as stops for the bead. These stops may be in groups of five or ten with a starting position 135 as in the previous embodiments.

A common feature of all the embodiments here disclosed is that a bead is moved along a defined path. Consequently, the rosary prayer device can be used in a manner similar to a conventional rosary. Accordingly, the user can experience the same movements and tactile sensations as are experienced when using a conventional rosary. But, unlike the conventional rosary, the present prayer device will not tangle upon itself or with other objects that are often carried in a pocket or purse.

Although I have shown and described certain present preferred embodiments of my rosary prayer device, it should be distinctly understood that my invention is not limited thereto, but may be variously embodied within the scope of the following claims.

I claim:

1. A rosary prayer device comprised of:

a generally circular rigid body having a vacant generally circular center, the generally circular body comprised of a plurality of distinct sections defined by markings or spaces on the body, each section having two ends, the sections being joined end to end and each section having a surface containing a plurality of stops; and a bead positioned on one of the sections of the circular body and sized to travel along each section, to move from one section to another and to remain between any two selected stops until pushed over one of the two selected stops.

2. The rosary prayer device of claim 1 wherein the stops are projections, ridges or teeth.

3. The rosary prayer device of claim 1 wherein the stops are recesses or grooves.

4. The rosary prayer device of claim 1 wherein the bead is made of a flexible material.

5. The rosary prayer device of claim 1 also comprising a projection on the bead which engages at least one of the stops.

6. The rosary prayer device of claim 5 wherein the projection is of a size, shape and material so that an audible click is produced when the bead passes over a stop.

7. The rosary prayer device of claim 1 also comprising an arm extending outwardly from the bead.

8. The rosary prayer device of claim 1 wherein the generally circular body is shaped like a bracelet.

9. The rosary prayer device of claim 1 wherein each of the sections is linear and has an identical length such that the generally circular body is a pentagon.

10. The rosary prayer device of claim 1 wherein the bead has a cross-section which is a polygon.

11. The rosary prayer device of claim 1 wherein the generally circular body is comprised of two spaced apart sections that define a path around the generally circular body, the bead is positioned between the two spaced apart sections and the stops are on an inside surface of at least one of the spaced apart sections.

12. The rosary prayer device of claim 1 wherein the bead contains a cavity and is further comprised of a spring and ball within the cavity, the cavity and ball configured such that the ball will engage the stops on the ring as the bead travels around the ring.

13. The rosary prayer device of claim 1 wherein the generally circular body and bead are molded as a unitary structure with the bead being attached to the generally circular body by a frangible joint.

14. The rosary prayer device of claim 1 wherein the bead has a keyhole-shaped passage through which the generally circular body passes as the bead travels along the housing.

15. The rosary prayer device of claim 1 wherein two of the sections are adjacent to one another and are releasably joined together end to end such that these sections can be separated from one another.

16. A rosary prayer device comprised of:

a generally circular body having a vacant generally circular center, the generally circular body comprised of a plurality of distinct sections each section having two ends, the sections being joined end to end and each section having a surface containing a plurality of stops; and a bead positioned on one of the sections of the circular body and sized to travel along each section, to move from one section to another and to remain between any two selected stops until pushed over one of the two selected stops;

wherein the bead also comprises a projection which causes the bead to rotate as the bead passes over a stop.

17. The rosary prayer device of claim 16 wherein the projection and bead are sized and configured so that the bead will make one complete rotation upon passing over ten stops.

18. The rosary prayer device of claim 17 also comprising indicia on the bead to indicate an amount by which the bead has rotated which amount corresponds to how many stops the bead has passed.

* * * * *